US006670768B1

(12) United States Patent
Labant

(10) Patent No.: US 6,670,768 B1
(45) Date of Patent: Dec. 30, 2003

(54) BLUE INCANDESCENT GENERAL PURPOSE LAMP

(75) Inventor: Cynthia J. Labant, St. Marys, PA (US)

(73) Assignee: Osram Sylvania Inc., Danvers, MA (US)

( * ) Notice: Subject to any disclaimer, the term of this patent is extended or adjusted under 35 U.S.C. 154(b) by 9 days.

(21) Appl. No.: 10/200,649

(22) Filed: Jul. 22, 2002

(51) Int. Cl.[7] ..... H01J 17/16; H01J 61/30; H05B 41/24

(52) U.S. Cl. ..... 315/112; 313/635

(58) Field of Search ..... 315/112, 248, 315/276, 62; 313/332, 486, 489, 110, 112, 635, 636, 478, 630; 428/432

(56) References Cited

U.S. PATENT DOCUMENTS 3,987,335 A * 10/1976 Anderson ..... 315/62
5,552,665 A * 9/1996 Trushell ..... 313/489
5,619,102 A * 4/1997 Scholler ..... 313/635
5,834,905 A * 11/1998 Godyak et al. ..... 315/248
5,898,265 A * 4/1999 Woodward et al. ..... 313/486
2003/0027000 A1 * 2/2003 Greenberg et al. ..... 428/432
2003/0076026 A1 * 4/2003 Trent et al. ..... 313/332

* cited by examiner

*Primary Examiner*—Don Wong
*Assistant Examiner*—Chuc Tran
(74) *Attorney, Agent, or Firm*—Wiliam H. McNeill

(57) ABSTRACT

An electric lamp (10) which emits a blue color when energized and which comprises a light transmissive envelope (12) enclosing an electric light source (16) within, said envelope (12) having a surface (11) on which is a coating comprising precipitated silica, aluminum silicate pigment, manganese ammonium pyro phosphate and cobalt aluminate spinel. The lamp is useful for general household illumination and provides pleasing skin tones.

3 Claims, 1 Drawing Sheet

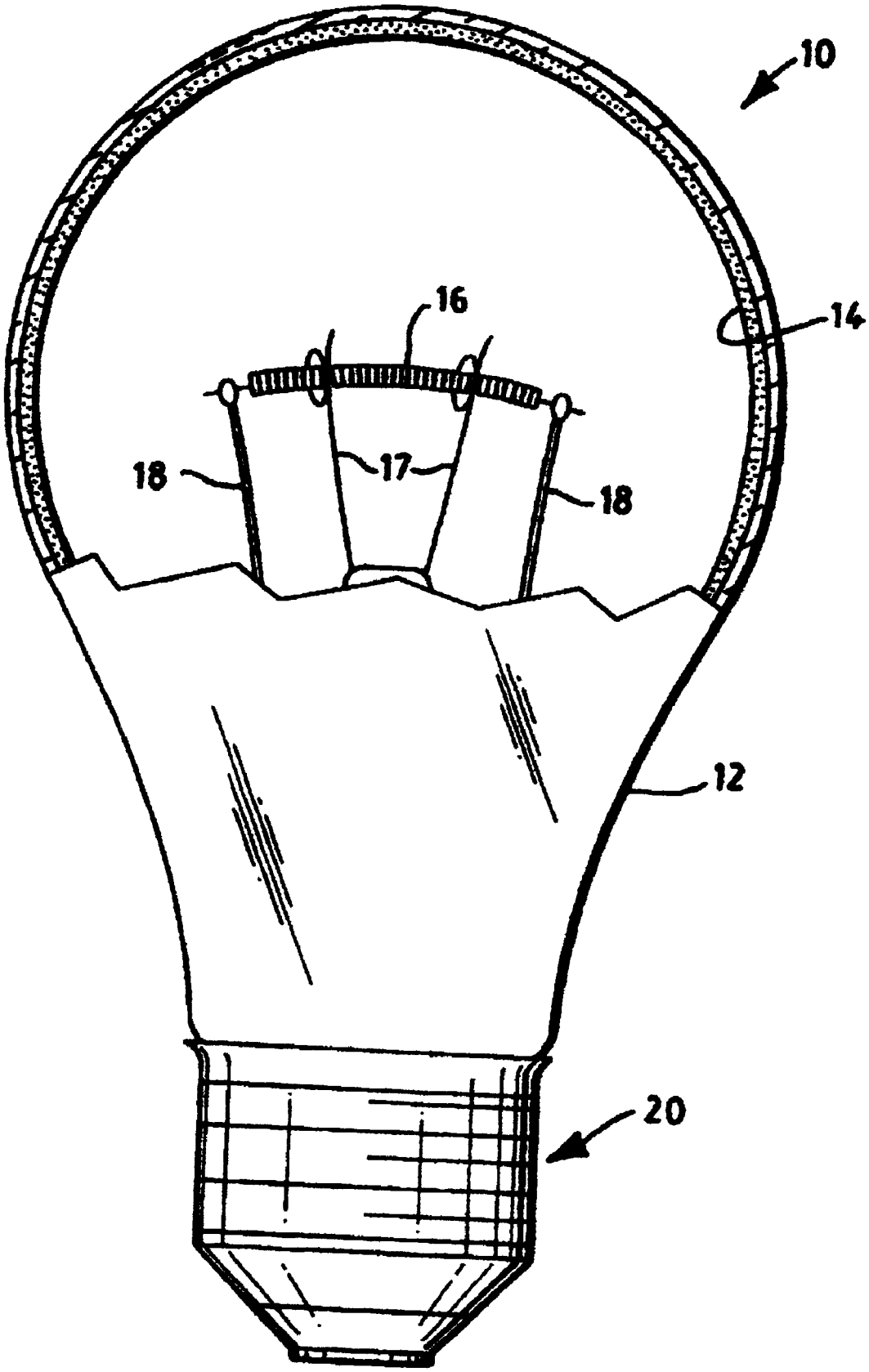
10
16
14
18
17
18
12
20

BLUE INCANDESCENT GENERAL PURPOSE LAMP

TECHNICAL FIELD

This invention relates to incandescent lamps and more particularly to general purpose lamps having a particular emission spectra. Still more particularly, it relates to lamps useful for household lighting and has still greater applicability where enhanced skin tones are desired.

BACKGROUND ART

Common household incandescent lamps emit light that is high in the yellow/green portion of the spectrum. While suitable for most illumination it has been objected to as being deficient when it come to illuminating normal skin tones. A recent development in the art has provided a general purpose household lamp with strong emission in the blue/white portion of the spectrum which has been deemed to provide a more aesthetically pleasing appearance, especially when the important skin tone appearance is considered. However, this particular blue/white spectrum has been achieved by developing a new glass for the lamp envelope, which glass uses an additive of neodymium in the form of $Nd_2O_3$, a material which adds approximately 15–20 cents to the cost of the lamp envelope. It would be an advance in the art to provide a lamp that has a similar color output at a more conventional cost.

DISCLOSURE OF INVENTION

It is, therefore, an object of the invention to obviate the disadvantages of the prior art.

It is another object of the invention to enhance general purpose household lamps.

It is yet another object of the invention to provide a general purpose household lamp lamp that is environmentally safe, allowing the spent lamp to be landfilled.

These objects are accomplished, in one aspect of the invention, by the provision of an electric lamp which emits a blue color when energized and which comprises a light transmissive envelope formed from a typical soda/lime glass and enclosing an electric light source within. The envelope has an internal surface on which is a coating comprising precipitated silica, aluminum silicate pigment, manganese ammonium pyro phosphate and cobalt aluminate spinel.

The soft blue color provides a higher color temperature and enhances the lighting appearance, particularly of skin tones. The internal powder coating uses an environmentally safe formula that enables the spent lamp to be landfilled.

BRIEF DESCRIPTION OF THE DRAWINGS

The single figure is a diagrammatic view, partially in section, illustrating an embodiment of the invention.

BEST MODE FOR CARRYING OUT THE INVENTION

For a better understanding of the present invention, together with other and further objects, advantages and capabilities thereof, reference is made to the following disclosure and appended claims in conjunction with the above-described drawing.

Referring now to the drawing with greater particularity, there is shown in the figure an A-line incandescent type lamp 10 having on an interior surface 11 of its light transmissive glass envelope 12 a coating 14 in accordance with an aspect of the invention. A filament 16 of, for example, tungsten, is electrically connected to and supported by lead-ins 18 which extend through the seal of the lamp and are attached, as is known, to a screw base 20. Other forms of bases can be employed, such as the type known in the art as bayonet bases. Additionally, other support for the filament 16 can be provided by support wires 17.

The interior surface 11 of envelope 12 is coated with a powder coating 14. Coating 14 is applied electrostatically by means well know to those skilled in the art, see, for example U.S. Pat. Nos. 2,995,463; 3,125,457; 3,320,460 and 4,633,127.

The coating 14 of the present invention comprises precipitated silica, aluminum silicate pigment, manganese ammonium pyro phosphate and cobalt aluminate spinel. The lamp, when energized, has color coordinates of X=0.4373 to 0.4382 and Y=0.3973 to 0.3983 on a standard ICI diagram and a color temperature of between 2931 and 2941. The ICI diagram (International Commission on Illumination) is also known, especially in England and the European continent as the CIE (Commission Internationale d'Eclairage) system or diagram. The CRI of tested 60 watt lamps averages 91 and the light output averaged 575 lumens.

The applied powder was formulated by combining, in wt. %, 48 to 50% PPG Hi-Sil T-700 Precipitated Silica; 38 to 40% Burgess 50 Aluminum Silicate Pigment, 6.5 to 7.5% Shepard Violet #11 Manganese Ammonium Pyro Phosphate, and from 3.0 to 4.0 Shepard Blue #3 Cobalt Aluminate Spinel.

This coating costs less than 1 cent per lamp envelope and would be applicable to many bulb sizes, including A15, A19 A21 three ways, G25 and B10 shapes.

While there have been shown and described what are at present considered to be the preferred embodiments of the invention, it will be apparent to those skilled in the art that various changes and modification can be made herein without departing from the scope of the invention as defined by the appended claims.

What is claimed is:

1. An electric lamp which emits a blue color when energized and which comprises a light transmissive envelope of soda/lime glass enclosing an electric light source within, said envelope having a surface on which is a coating comprising precipitated silica, aluminum silicate pigment, manganese ammonium pyro phosphate and cobalt aluminate spinel.

2. The lamp of claim 1 wherein said precipitated silica comprises about 48 to 50 wt. % of said coating; said aluminum silicate pigment comprises about 38 to 40 wt. % of said coating, said manganese ammonium pyro phosphate comprises 6.5 to 7.5 wt. % of said coating and said cobalt aluminate spinel comprises about 3.0 to 4.0 wt. % of said coating.

3. The lamp of claim 1 wherein said blue color emitted when said lamp is energized has coordinates of X=0.4373 to 0.4383 and Y=0.3977 to 0.3983 on a standard ICI diagram.

* * * * *